US011378231B2

(12) United States Patent
Sawai

(10) Patent No.: US 11,378,231 B2
(45) Date of Patent: Jul. 5, 2022

(54) PRESSURE VESSEL MANUFACTURING METHOD

(71) Applicant: TOYOTA JIDOSHA KABUSHIKI KAISHA, Aichi-ken (JP)

(72) Inventor: Osamu Sawai, Okazaki (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 170 days.

(21) Appl. No.: 16/663,344

(22) Filed: Oct. 25, 2019

(65) Prior Publication Data

US 2020/0182404 A1 Jun. 11, 2020

(30) Foreign Application Priority Data

Dec. 5, 2018 (JP) ..... JP2018-228535

(51) Int. Cl.
*F17C 1/16* (2006.01)
*F17C 1/02* (2006.01)

(52) U.S. Cl.
CPC ..... *F17C 1/16* (2013.01); *F17C 1/02* (2013.01); *F17C 2201/0138* (2013.01); *F17C 2203/0621* (2013.01); *F17C 2209/2109* (2013.01)

(58) Field of Classification Search
CPC ..... F17C 1/16; F17C 1/02; F17C 2201/0138; F17C 2203/0621; F17C 2209/2109; F17C 2203/0619; F17C 2203/0624; F17C 2203/0663
USPC ..... 220/666, 672, 581, 289
See application file for complete search history.

(56) References Cited

U.S. PATENT DOCUMENTS

| | | | | |
|---|---|---|---|---|
| 9,217,538 | B2 * | 12/2015 | Griffith | F17C 1/00 |
| 10,690,288 | B2 * | 6/2020 | Griffith | F17C 1/16 |
| 2014/0305951 | A1 * | 10/2014 | Griffith | F17C 1/00 220/581 |
| 2015/0048095 | A1 * | 2/2015 | Sanders | B63C 11/08 220/586 |
| 2016/0363265 | A1 * | 12/2016 | Griffith | F17C 1/16 |
| 2017/0291328 | A1 | 10/2017 | Wexler et al. | |

FOREIGN PATENT DOCUMENTS

| | | | |
|---|---|---|---|
| CN | 107923572 | A | 4/2018 |
| JP | H11291361 | A | 10/1999 |
| JP | 2018-519480 | A | 7/2018 |
| WO | 2016/205372 | A2 | 12/2016 |

OTHER PUBLICATIONS

Sang Yunshui et al., "On-line inspection, safety evaluation and repair technology for transmission pipelines", China University of Petroleum Press, pp. 239-241, Dec. 2005, 12pp.

* cited by examiner

*Primary Examiner* — J. Gregory Pickett
*Assistant Examiner* — Niki M Eloshway
(74) *Attorney, Agent, or Firm* — Hauptman Ham, LLP

(57) ABSTRACT

Provided is a high-pressure vessel manufacturing method including: molding a liner having a pleated part; forming a fiber-reinforced part on an outer circumferential side of the liner; curving the liner and the fiber-reinforced part; and pressurizing and heating the liner and the fiber-reinforced part. In the molding the liner, the height of first pleats of the pleated part that are disposed on the inner side of the curve relative to an axis is set to be smaller than a height of second pleats of the pleated part that are disposed on the outer side of the curve relative to the axis.

8 Claims, 13 Drawing Sheets

PRESSURE VESSEL MANUFACTURING METHOD

INCORPORATION BY REFERENCE

The disclosure of Japanese Patent Application No. 2018-228535 filed on Dec. 5, 2018 including the specification, drawings and abstract is incorporated herein by reference in its entirety.

BACKGROUND

1. Technical Field

The present disclosure relates to a pressure vessel manufacturing method.

2. Description of Related Art

Japanese Patent Application Publication No. 2018-519480 (JP 2018-519480 A) discloses a method of forming a pressure vessel by connecting tubes having a resin liner to each other through a flexible connector and then folding the flexible connector. This flexible connector has a corrugated part. A dry braiding is put on the resin liner, and resin is further applied to the braiding.

SUMMARY

In the field of manufacturing of a pressure vessel of which the outer side of a resin cylindrical connecting part is reinforced with a reinforcing part as in JP 2018-519480 A, there is a known method in which a connecting part that connects vessel main bodies to each other is pleated and curved, and then heated and pressurized to manufacture a pressure vessel. Curving the connecting part in this method causes a difference in the length in a curving direction of the connecting part between the inner side and the outer side of the curve, which in turn causes a difference in the state of an inner surface of the connecting part between these sides.

More particularly, on the outer side of the curve, the length in the curving direction of the connecting part is long and the pleated part is stretched out in the curving direction, leaving a small clearance between ridges of the pleated part and the reinforcing part. Conversely, on the inner side of the curve, the length in the curving direction of the connecting part is short and the pleated part is less stretched out in the curving direction, so that a larger space is left between ridges of the pleated part and the reinforcing part than on the outer side of the curve. A large space between the ridges of the pleated part and the reinforcing part means a high degree of freedom for deformation of the pleated part. Thus, when the connecting part is curved and the inside of the curved connecting part is pressurized, the part of the liner on the inner side of the curve may become prone to deformation compared with the part thereof on the outer side of the curve. There is room for improvement here.

In view of this fact, the present disclosure aims to devise a pressure vessel manufacturing method that can ensure that when a pleated tubular body and a reinforcing part are curved and the inside of the curved tubular body is pressurized, a part of the tubular body on the inner side of the curve is less prone to deformation.

A pressure vessel manufacturing method of a first aspect of the present disclosure includes: molding a resin tubular body that connects one vessel main body and another vessel main body to each other, with a pleated part formed at least at part of the tubular body in an axial direction; forming a reinforcing part that reinforces the tubular body on the outer circumferential side of the tubular body; curving the tubular body and the reinforcing part such that an axis of the tubular body draws a curved line; and heating the tubular body and the reinforcing part while pressurizing the inside of the curved tubular body. In the molding the tubular body, the height of first pleats of the pleated part that are disposed on the inner side of the curve relative to the axis is set to be smaller than the height of second pleats of the pleated part that are disposed on the outer side of the curve relative to the axis.

In the pressure vessel manufacturing method of the first aspect, the height of the first pleats is set to be smaller than the height of the second pleats. This allows the first pleats to be stretched out along the curving direction at a part of the tubular body on the inner side of the curve when the tubular body and the reinforcing part are curved. In other words, the clearance between ridges of the first pleats and the reinforcing part is reduced. As a result, the area of contact between the first pleats and the reinforcing part is increased and the degree of freedom for deformation of the first pleats is reduced. Thus, this method can ensure that when a pleated tubular body and a reinforcing part are curved and then the inside of the curved tubular body is pressurized, the part of the tubular body on the inner side of the curve is less prone to deformation.

In a pressure vessel manufacturing method of a second aspect of the present disclosure, the amount of a pressure applied to pressurize the inside of the tubular body may be set such that the first pleats after heating form a curved part extending along the reinforcing part.

In the pressure vessel manufacturing method of the second aspect, a predetermined pressure is applied in the process of heating the tubular body while pressurizing the inside of the tubular body, so that not only the second pleats but also the first pleats are deformed so as to have a smaller height after heating. Moreover, the first pleats after heating form a curved part extending along the reinforcing part. Thus, applying the predetermined pressure to the first pleats and the second pleats can cause not only the second pleats but also the first pleats to assume a shape extending along the axial direction. As a result, the area of contact between the first pleats and the reinforcing part is increased compared with when a low pressure is applied, and the clearance between the first pleats and the reinforcing part after heating can be reduced accordingly.

The present disclosure can ensure that when a pleated tubular body and a reinforcing part are curved and then the inside of the curved tubular body is pressurized, the part of the tubular body on the inner side of the curve is less prone to deformation.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

First Embodiment

A vehicle 10 to which a high-pressure vessel 30 as an example of a pressure vessel according to a first embodiment is applied, the high-pressure vessel 30, and a manufacturing method of the high-pressure vessel 30 will be described.

Overall Configuration

Figure 1:
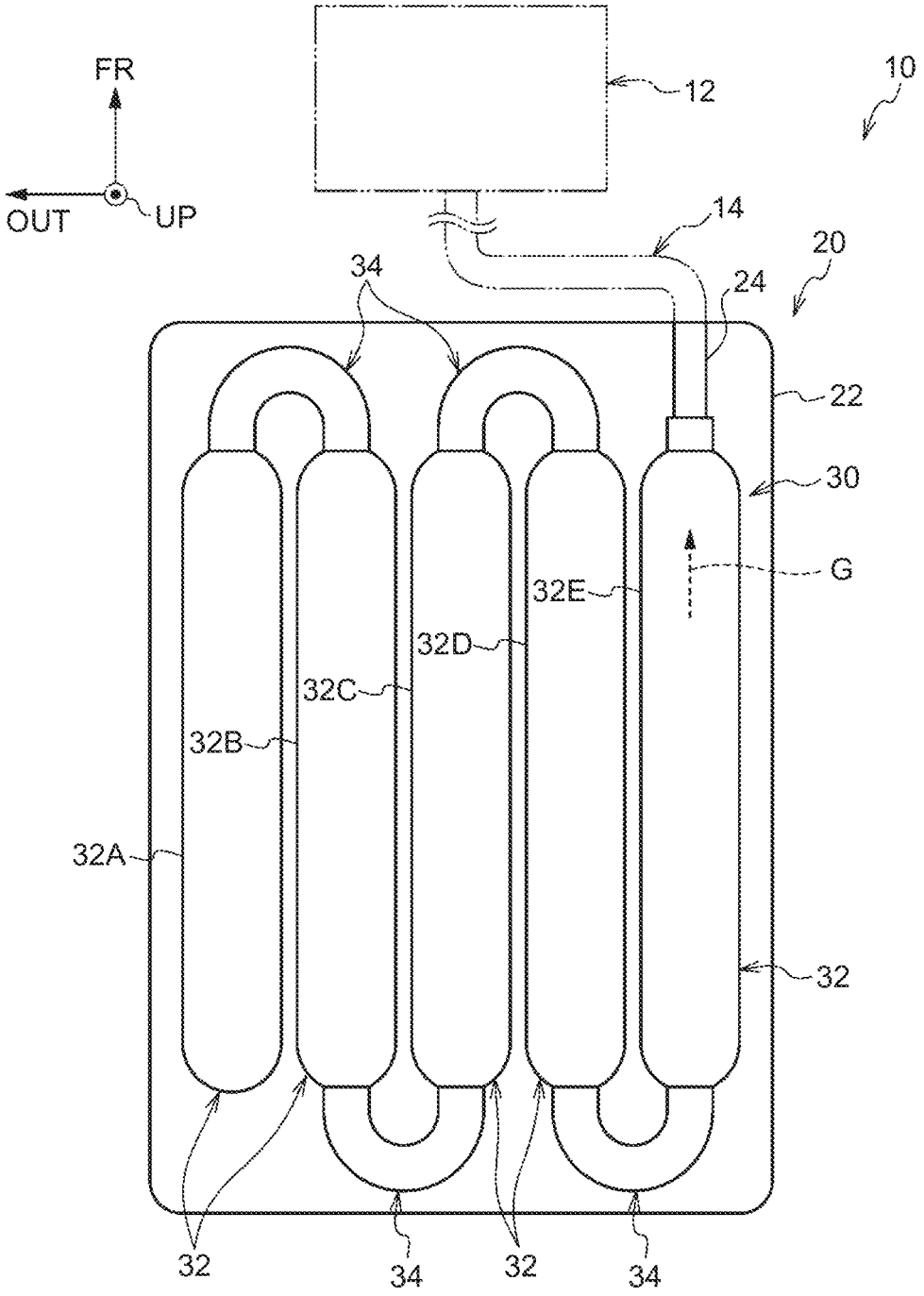
FIG. 1 is a plan view of a pressure vessel unit having a high-pressure vessel according to a first embodiment.

FIG. 1 shows part of the vehicle 10. The vehicle 10 includes a fuel cell stack 12, a supply pipe 14, a driving motor (not shown), and a pressure vessel unit 20. The arrows FR, UP, and OUT shown in FIG. 1 indicate a vehicle front side, a vehicle upper side, and an outer side in a vehicle width direction, respectively.

The fuel cell stack 12 and the pressure vessel unit 20 are connected to each other through the supply pipe 14. The fuel cell stack 12 generates electricity through electrochemical reactions between a hydrogen gas G that is an example of a gas supplied from the pressure vessel unit 20 and compressed air that is supplied from an air compressor (not shown). Part of electricity resulting from electricity generation in the fuel cell stack 12 is supplied to the driving motor (not shown). The driving motor is driven by electricity supplied from the fuel cell stack 12. Driving power of the driving motor is transmitted to rear wheels (not shown) of the vehicle 10.

The pressure vessel unit 20 is disposed on a vehicle lower side of a floor panel (not shown) that forms a floor surface of a vehicle cabin of the vehicle 10. The pressure vessel unit 20 includes a case 22, a lead-out pipe 24, and the high-pressure vessel 30 to be described later. The high-pressure vessel 30 and the lead-out pipe 24 are disposed inside the case 22. The lead-out pipe 24 connects the high-pressure vessel 30 and the supply pipe 14 to each other.

Configuration of Main Parts

Next, the high-pressure vessel 30 will be described.

For example, the high-pressure vessel 30 has five vessel main bodies 32 and four connecting parts 34. More particularly, the high-pressure vessel 30 has a structure in which the five vessel main bodies 32 and the four connecting parts 34 are connected in series to one another, with each connecting part 34 connecting two vessel main bodies 32 to each other. In the high-pressure vessel 30, the four connecting parts 34 are curved (so as to be folded) alternately in opposite directions, so that the five vessel main bodies 32 are disposed in a row in the vehicle width direction inside the case 22.

The high-pressure vessel 30 of this embodiment is formed, for example, by separately molding the vessel main bodies 32 and the connecting parts 34 and then integrating these vessel main bodies 32 and connecting parts 34 by adhesion. However, the vessel main bodies 32 and the connecting parts 34 may instead be integrally molded. Specifically, the high-pressure vessel 30 may be formed by integrally molding the five vessel main bodies 32 and the four connecting parts 34 in a straight line, and then curving the four connecting parts 34 so as to be folded.

Vessel Main Body

The vessel main body 32 has a substantially cylindrical shape elongated in a vehicle front-rear direction. Both end portions of the vessel main body 32 have a hemispherical shape. Moreover, the vessel main body 32 has, for example, a cross-sectional structure in which a fiber-reinforced part 52 (see FIG. 4) is laid on an outer circumferential surface of a liner 36 (see FIG. 4) to be described later. For example, the vessel main body 32 has the same layered structure as the connecting part 34 to be described later. The vessel main body 32 is formed, for example, by blow molding.

For example, the five vessel main bodies 32 are disposed with both front ends and rear ends thereof in the vehicle front-rear direction aligned in the vehicle width direction. Here, to make distinctions among the five vessel main bodies 32, the vessel main body 32 farthest away from the lead-out pipe 24 will be referred to as a vessel main body 32A, and the vessel main body 32 next to the vessel main body 32A will be referred to as a vessel main body 32B. Similarly, to make distinctions among the other three vessel main bodies 32, these will be referred to as vessel main bodies 32C, 32D, 32E toward the lead-out pipe 24. When no distinctions are made among the five vessel main bodies 32, these will be referred to as the vessel main bodies 32.

The vessel main body 32A is an example of one vessel main body. The vessel main body 32A is closed at one end (rear end) in the vehicle front-rear direction. The vessel main body 32A is open at the other end (front end). At the other end of the vessel main body 32A, one end of the connecting part 34, to be described later, is connected by adhesion.

The vessel main body 32B is an example of another vessel main body. The vessel main body 32B is open at both ends. At the other end (front end) of the vessel main body 32B, the other end of the connecting part 34, to be described later, is connected. In other words, the connecting part 34 connects the vessel main body 32A and the vessel main body 32B to each other.

The vessel main bodies 32C, 32D, 32E have the same structure as the vessel main body 32B. At the other end of the vessel main body 32E in the vehicle front-rear direction, one end of the lead-out pipe 24 in the vehicle front-rear direction is connected.

Connecting Part

The connecting part 34 is formed as a cylindrical member, elongated in one direction, that is curved toward a direction orthogonal to that one direction (axial direction) so as to have a U-shape as a whole. The hydrogen gas G can flow through an inside of the connecting part 34. One connecting part 34 is connected to the vessel main body 32A and the vessel main body 32B by adhesion. In other words, one connecting part 34 connects the vessel main body 32A and the vessel main body 32B to each other. The outside diameter of the connecting part 34 is smaller than the outside diameter of the vessel main body 32.

Figure 4:
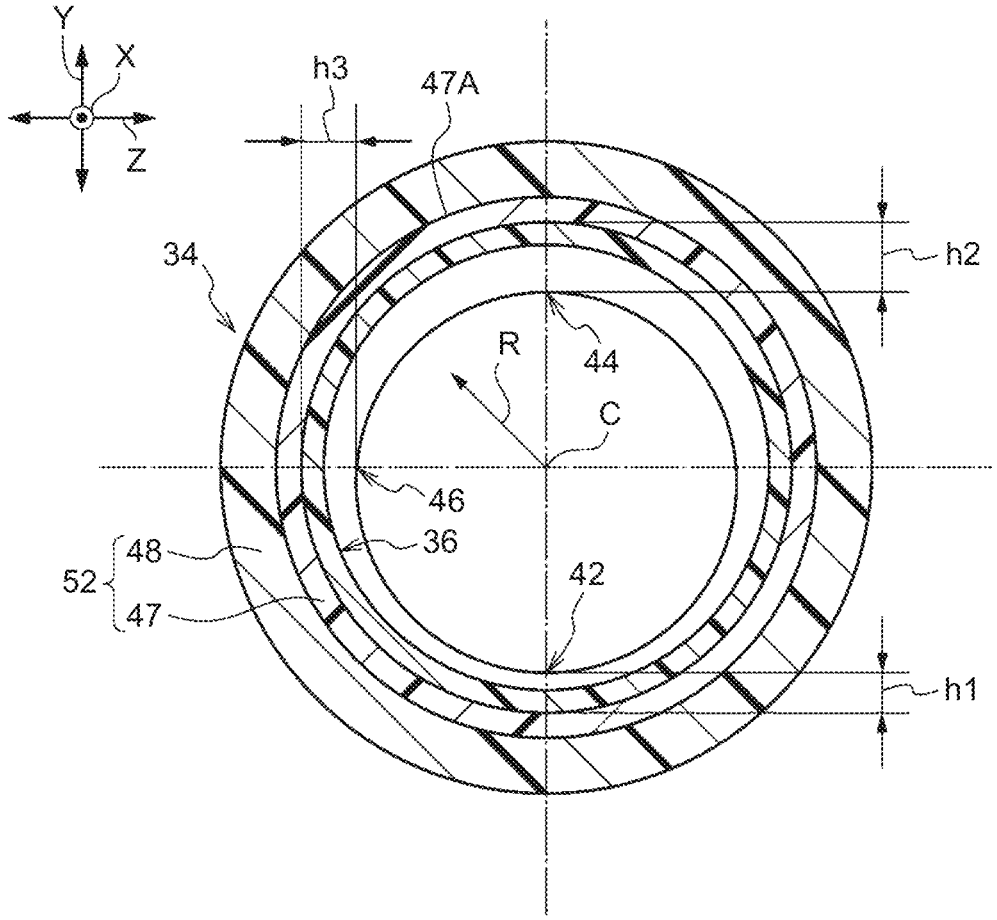
FIG. 4 is a vertical sectional view of a connecting part in the high-pressure vessel of FIG. 1, as seen from the axial direction.

FIG. 4 shows a cross-section of the connecting part 34 as seen from the axial direction. In the subsequent description, the axial direction of the connecting part 34 will be referred to as an X-direction, regardless of whether or not the connecting part 34 is curved. A direction which is orthogonal to the X-direction and in which, when the connecting part 34 is curved, a portion of the connecting part 34 on the inner side of the curve and a portion thereof on the outer side of the curve are located side by side will be referred to as a Y-direction (vertical direction). Moreover, a direction orthogonal to both the X-direction and the Y-direction will be referred to as a Z-direction (lateral direction). In addition, a radial direction relative to a center C of the connecting part 34 as seen from the X-direction will be referred to as an R-direction.

The connecting part 34 has the liner 36 as an example of a tubular body, and the fiber-reinforced part 52 as an example of a reinforcing part that reinforces the liner 36.

Liner

Figure 2A:
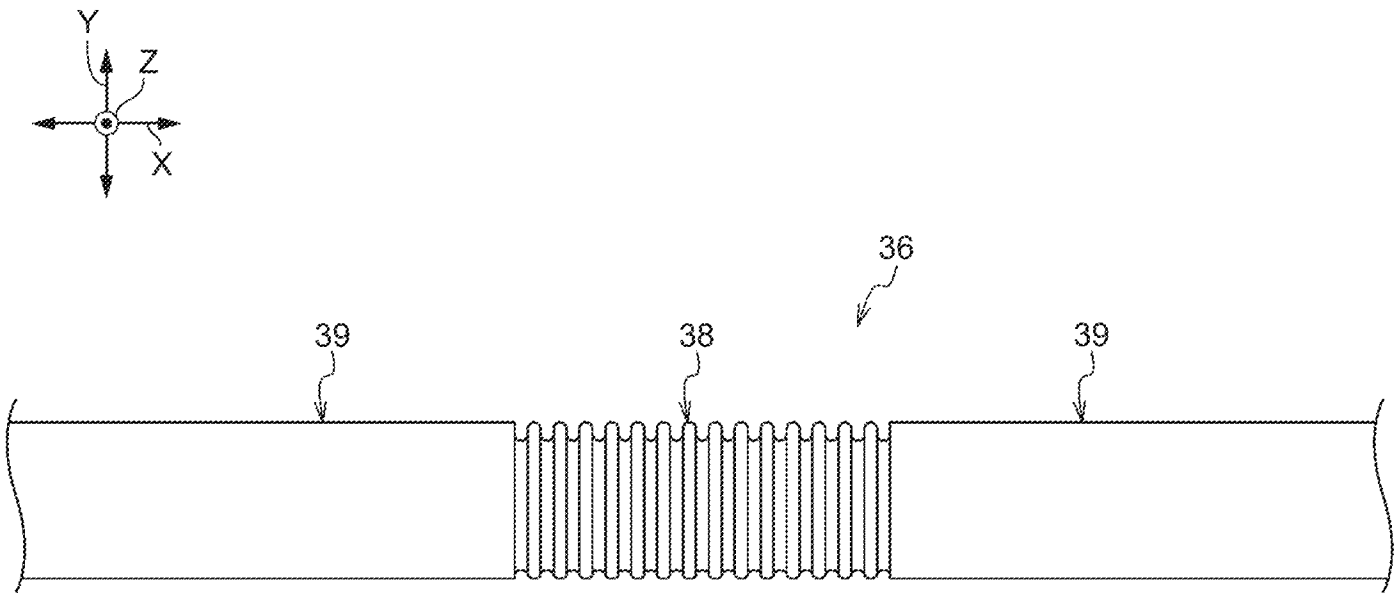
FIG. 2A is a side view of a liner in the high-pressure vessel of FIG. 1.

FIG. 2A shows the liner 36 before being curved, as seen from the Z-direction. For example, the liner 36 is made of a nylon resin having gas barrier properties. The liner 36 has one pleated part 38 formed at a center part in the X-direction, and two cylindrical parts 39 formed one on each side of the pleated part 38 in the X-direction. For example, the length in the X-direction of the pleated part 38 is about a quarter of the length in the X-direction of the liner 36.

Figure 2B:
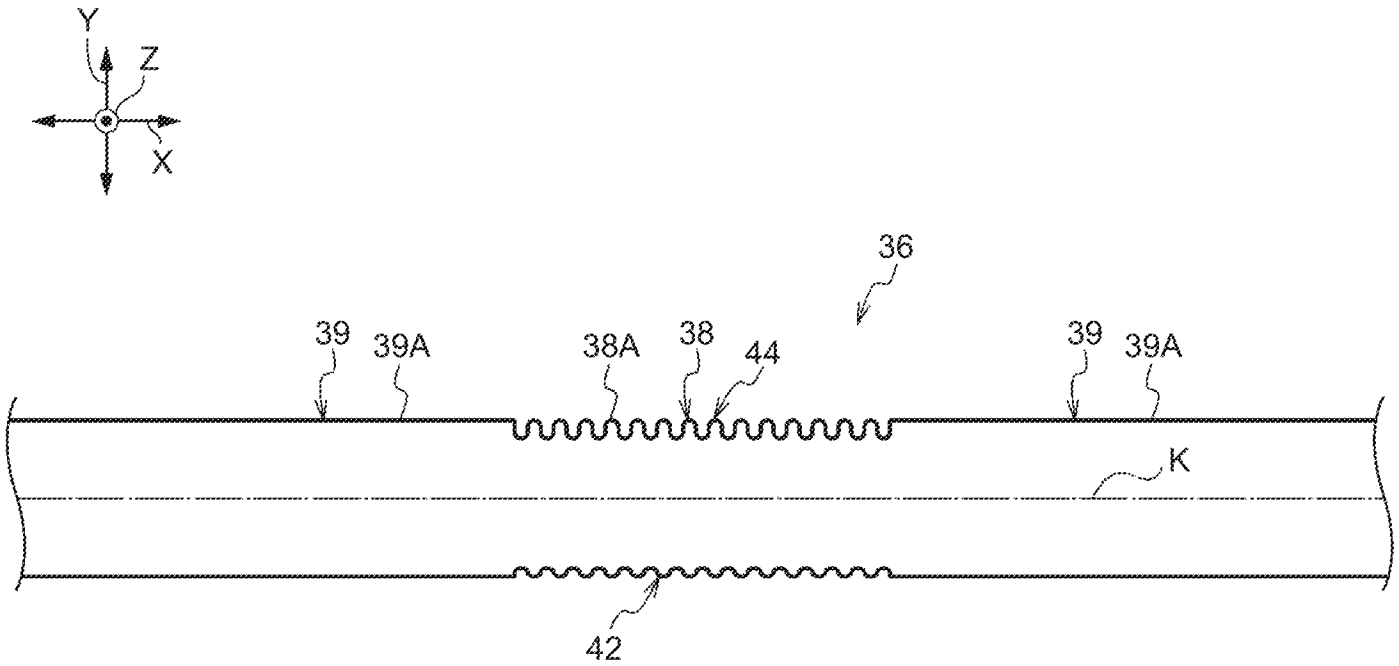
FIG. 2B is a vertical sectional view of the liner in the high-pressure vessel of FIG. 1, as seen from a direction orthogonal to an axial direction.

FIG. 2B shows a vertical section of the liner 36 cut along an X-Y plane at a center in the Z-direction. In the subsequent description, an imaginary axis passing through the center C of the liner 36 (see FIG. 4) and extending in the X-direction will be referred to as an axis K. In the Y-direction, the side corresponding to the outer side of the curve relative to the axis K will be referred to as an upper side, and the side corresponding to the inner side of the curve relative to the axis K will be referred to as a lower side. The lengths of the two cylindrical parts 39 in the X-direction are set to be equal. The two cylindrical parts 39 have no ridges and grooves formed therein. The two cylindrical parts 39 each have an outer circumferential surface 39A.

A surface of the pleated part 38 at a portion having a maximum outside diameter will be referred to as an outer circumferential surface 38A. The pleated part 38 has first pleats 42 and the second pleats 44 disposed respectively on the lower side and the upper side in the Y-direction as seen from the Z-direction. The first pleats 42 are a portion of the pleated part 38 that is disposed on the inner side of the curve relative to the axis K when the liner 36 is curved. The second pleats 44 are a portion of the pleated part 38 that is disposed on the outer side of the curve relative to the axis K when the liner 36 is curved.

Figure 5:
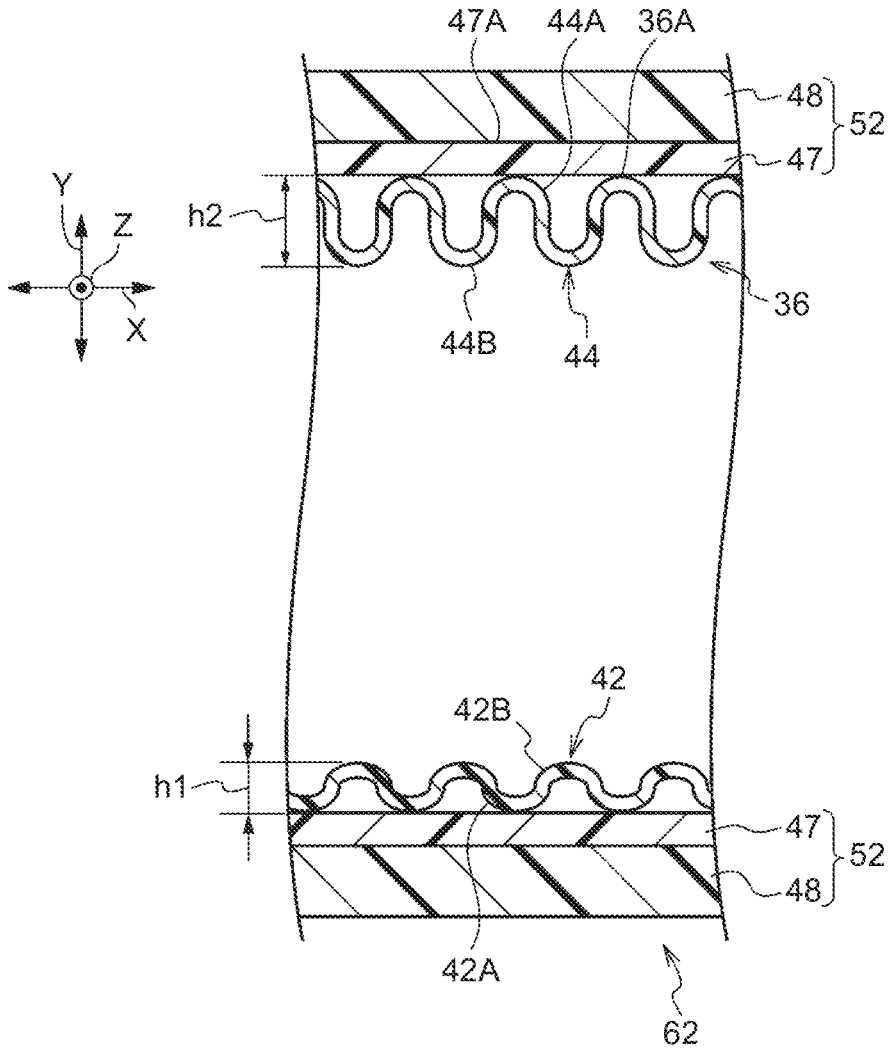
FIG. 5 is a partial vertical sectional view showing a close-up of part of the connecting part of FIG. 2B.

FIG. 5 shows enlarged cross-sections of the first pleats 42 and the second pleats 44 as seen from the Z-direction.

The first pleats 42 have a plurality of ridges 42A protruding from a center in the Y-direction of the first pleats 42 toward the fiber-reinforced part 52, and a plurality of grooves 42B depressed from the center in the Y-direction toward the axis K. The ridges 42A and the grooves 42B are alternately arrayed in the X-direction. The pitch in the X-direction of the ridges 42A and the pitch in the X-direction of the grooves 42B have an equal length. In the Y-direction, the length from a height position corresponding to a lower end of the groove 42B to a height position corresponding to an upper end of the ridge 42A will be defined as a height h1 [mm] of the first pleats 42.

The second pleats 44 have a plurality of ridges 44A protruding from a center in the Y-direction of the second pleats 44 toward the fiber-reinforced part 52, and a plurality of grooves 44B depressed from the center in the Y-direction toward the axis K. The ridges 44A and the grooves 44B are alternately arrayed in the X-direction. The pitch in the X-direction of the ridges 44A and the pitch in the X-direction of the grooves 44B have an equal length, which is also equal to the pitch in the X-direction of the ridges 42A and the pitch in the X-direction of the grooves 42B. In the Y-direction, the length from a height position corresponding to a lower end of the groove 44B to a height position corresponding to an upper end of the ridge 44A will be defined as a height h2 [mm] of the second pleats 44.

The height h1 is set to a height smaller than the height h2. In this embodiment, for example, the height h1 is smaller than half of the height h2. To cause such a difference between the height h1 and the height h2, one can process parts of a mold 70 for molding the liner 36 (see FIG. 6A) that respectively form the first pleats 42 and the second pleats 44 so as to adjust these parts to different heights.

The height h1 is preset such that when the liner 36 is curved and then the curved liner 36 is heated while the inside of the liner 36 is pressurized, the first pleats 42 stretched out in the curving direction come into close contact with an inner circumferential surface of the fiber-reinforced part 52 on the inner side of the curve.

The height h2 is preset such that when the liner 36 is curved and then the curved liner 36 is heated while the inside of the liner 36 is pressurized, the second pleats 44 stretched out in the curving direction come into close contact with an inner circumferential surface of the fiber-reinforced part 52 on the outer side of the curve.

Figure 3A:
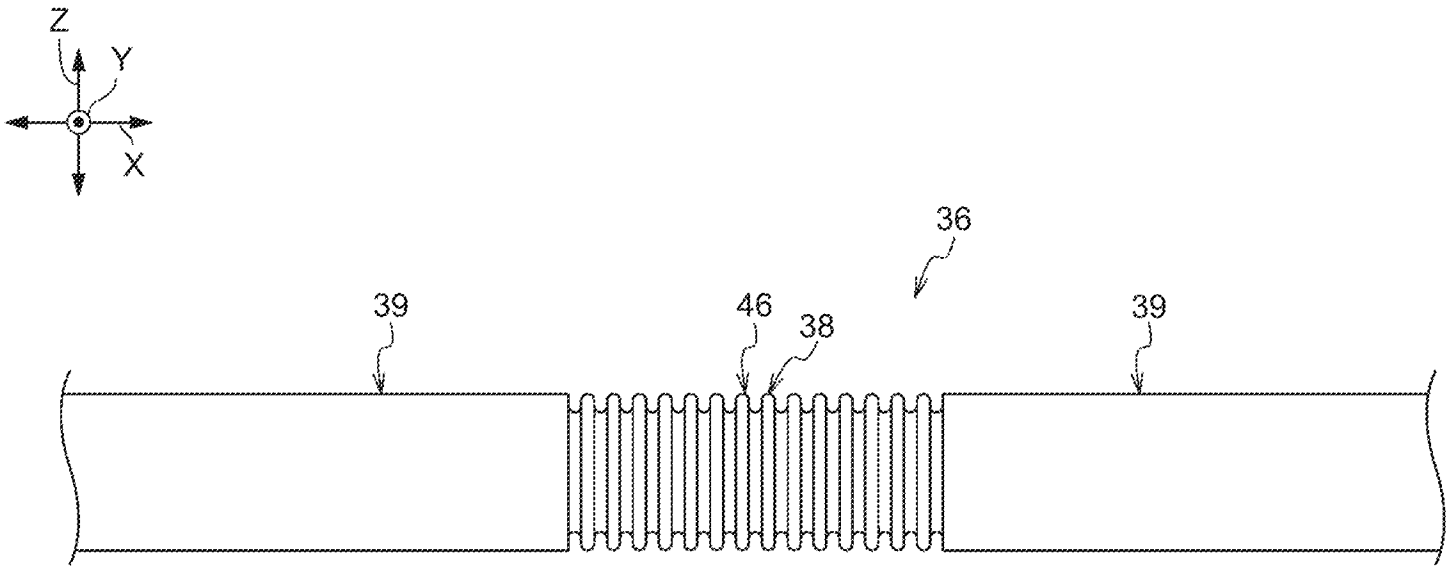
FIG. 3A is a plan view of the liner in the high-pressure vessel of FIG. 1.
Figure 3B:
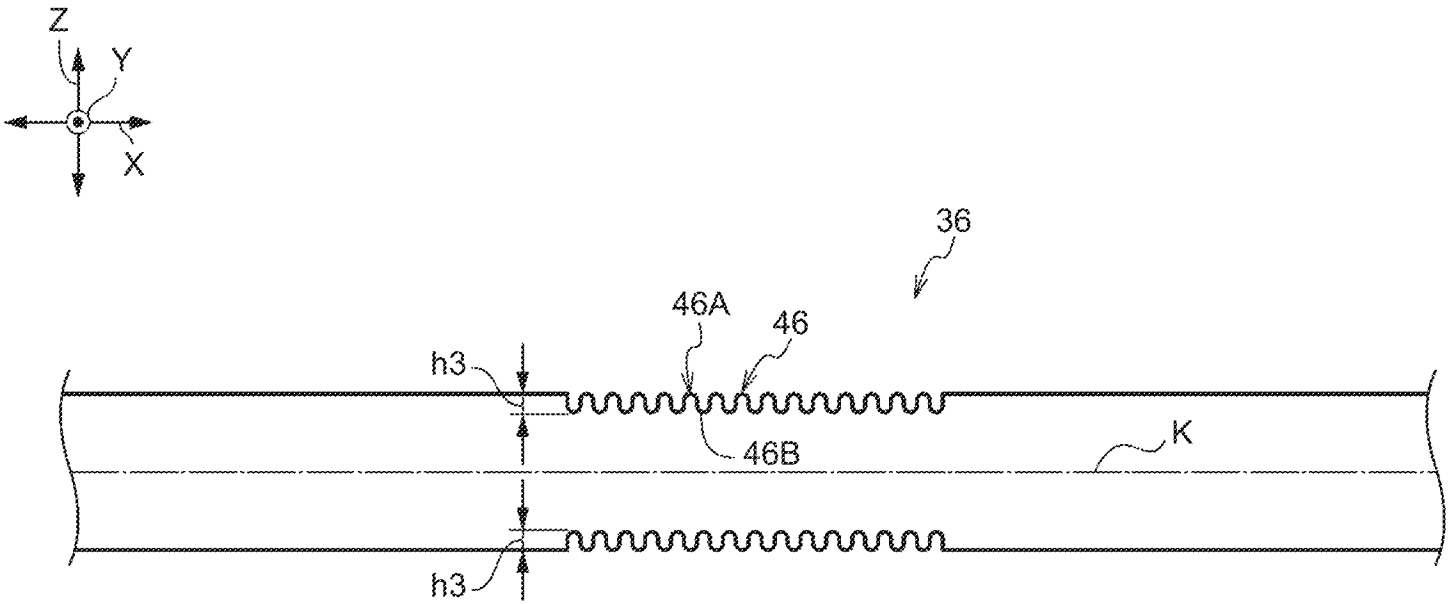
FIG. 3B is a horizontal sectional view of the liner in the high-pressure vessel of FIG. 1.

FIG. 3A shows the liner 36 before being curved, as seen from the Y-direction. FIG. 3B shows a horizontal section of the liner 36 cut along the X-Z plane at the center in the Y-direction. For example, the portions of the pleated part 38 on one side and the other side relative to the axis K are symmetrical as seen from the Y-direction. Therefore, only the portion on the one side as seen from the Y-direction will be described below while the description of the other portion will be omitted.

As shown in FIG. 3B, the pleated part 38 as seen from the Y-direction has third pleats 46.

The third pleats 46 have a plurality of ridges 46A protruding from a center in the Z-direction of the third pleats 46 toward the fiber-reinforced part 52 (see FIG. 4), and a plurality of grooves 46B depressed from the center in the Z-direction toward the axis K. The ridges 46A and the grooves 46B are alternately arrayed in the X-direction. The pitch in the X-direction of the ridges 46A and the pitch in the X-direction of the grooves 46B have an equal length. In the Z-direction, the length from a height position corresponding to an inner end of the groove 46B to a height position corresponding to an outer end of the ridge 46A will be defined as a height h3 [mm] of the third pleats 46.

For example, the height h3 shown in FIG. 4 is set to a height smaller than the height h2 and larger than the height h1. To set the height h3 to such a height, one can process a part of the mold 70 for molding the liner 36 (see FIG. 6A) that forms the third pleats 46 so as to adjust this part to a different height.

An inner circumferential surface of the portion having the height h1, an inner circumferential surface of the portion having the height h2, and an inner circumferential surface of a portion having the height h3 are formed such that these inner circumferential surfaces form a curved surface continuous in a circumferential direction of the pleated part 38. In other words, in the inner circumferential surface of the pleated part 38, the height in the R-direction is varied continuously in the circumferential direction, without any step formed in the inner circumferential surface of the pleated part 38. Such a pleated structure is called an eccentric pleated structure.

Fiber-Reinforced Part

For example, the fiber-reinforced part 52 has an inner reinforcing layer 47 and an outer reinforcing layer 48.

The inner reinforcing layer 47 is formed along the entire outer circumferential surface 38A and outer circumferential surfaces 39A (see FIG. 2B) in the X-direction so as to cover these outer circumferential surface 38A and outer circumferential surfaces 39A. For example, the inner reinforcing layer 47 is made of a carbon fiber-reinforced plastic (CFRP). For example, in the R-direction, the thickness of the inner reinforcing layer 47 is larger than the thickness of the liner 36. The inner reinforcing layer 47 has an outer circumferential surface 47A.

The outer reinforcing layer 48 is formed along the entire outer circumferential surface 47A in the X-direction so as to cover the outer circumferential surface 47A. For example, the outer reinforcing layer 48 is made of a glass fiber-reinforced plastic. For example, in the R-direction, the thickness of the outer reinforcing layer 48 is larger than the thickness of the inner reinforcing layer 47.

Workings and Effects

Next, the manufacturing method of the high-pressure vessel 30 of the first embodiment will be described.

Figure 6A:
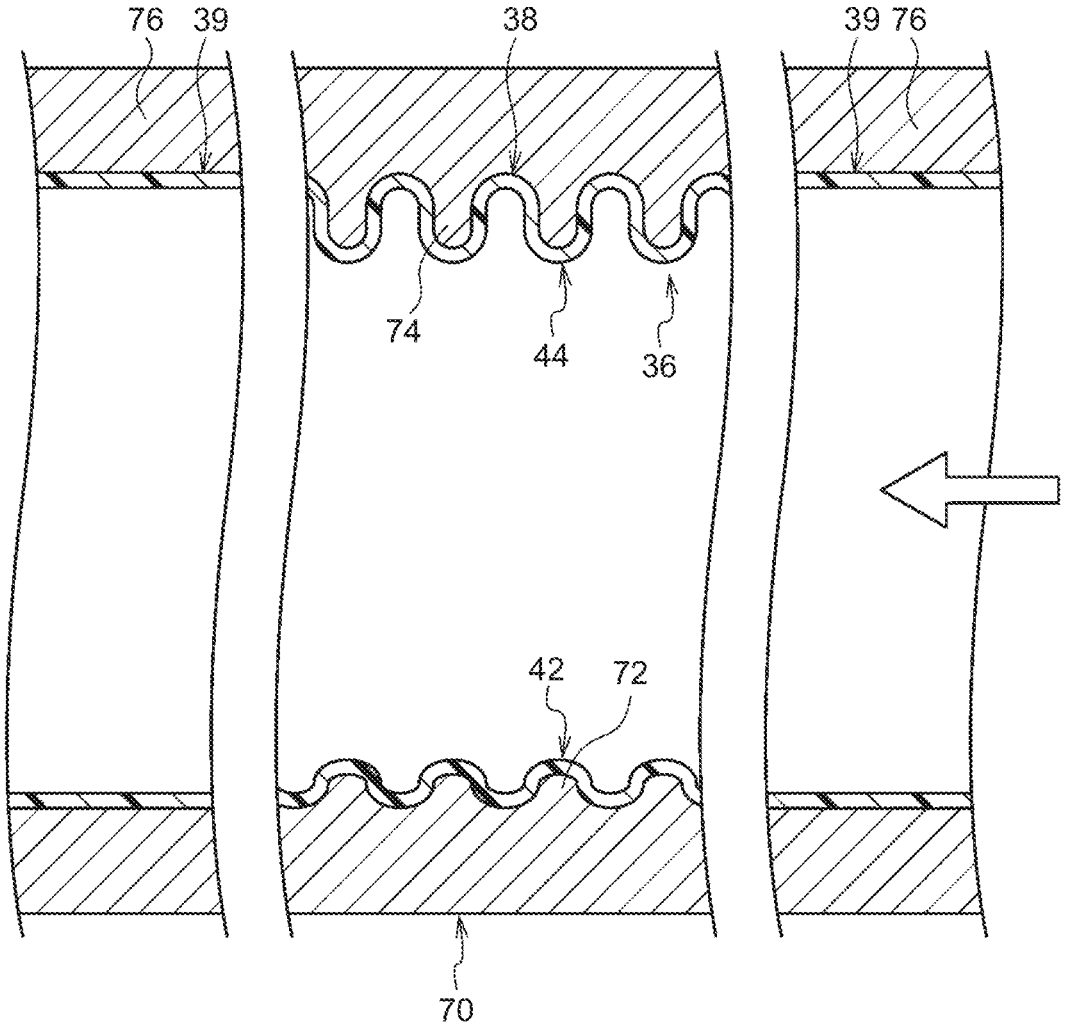
FIG. 6A is a vertical sectional view showing how an unprocessed connecting part in the high-pressure vessel of FIG. 1 is molded.

The mold 70 shown in FIG. 6A includes: a first corrugated part 72 that forms the first pleats 42; a second corrugated part 74 that forms the second pleats 44; a corrugated part (not shown) that forms the third pleats 46 (see FIG. 3B); and curved surface parts 76 that form the cylindrical parts 39. The height in the Y-direction of the first corrugated part 72 is set according to the height h1 (see FIG. 4). The height in the Y-direction of the second corrugated part 74 is set according to the height h2 (see FIG. 4). The height in the Z-direction of the corrugated part (not shown) is set according to the height h3 (see FIG. 4).

Here, a molten resin is delivered into the mold 70, and then air is delivered into the mold. As the resin is cooled, the liner 36 is molded. The molded liner 36 is taken out of the mold 70. Thus, the resin liner 36 is molded, for example, by a blow molding method (an example of a step of molding a tubular body). The liner 36 has the pleated part 38 formed therein.

Then, as shown in FIG. 5, the fiber-reinforced part 52 is formed on an outer circumferential side of the molded liner 36 (an example of a step of forming a reinforcing part). More particularly, carbon fibers impregnated with an uncured resin are wound around the outer circumferential surface 36A of the liner 36 (by braiding) to form the inner reinforcing layer 47. Then, glass fibers impregnated with an uncured resin are wound around the outer circumferential surface 47A of the inner reinforcing layer 47 to form the outer reinforcing layer 48. In this way, the fiber-reinforced part 52 is formed on the outer circumferential side of the liner 36 (an example of the step of forming the reinforcing part). The liner 36 that has the fiber-reinforced part 52 formed on the outer circumferential side and that is not curved yet (the liner 36 having a linear shape) will be referred to as an unprocessed connecting part 62.

Figure 6B:
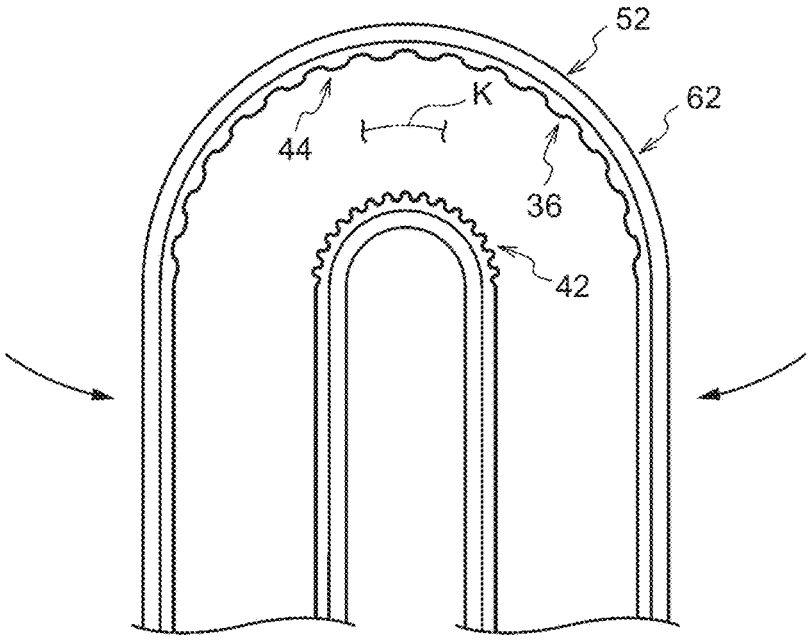
FIG. 6B is a vertical sectional view showing the unprocessed connecting part of FIG. 6A in a curved state.

Then, as shown in FIG. 6B, the unprocessed connecting part 62 is curved such that part of the axis K of the unprocessed connecting part 62 draws a curved line. Thus, the liner 36 and the fiber-reinforced part 52 are curved (an example of a curving step). The unprocessed connecting part 62 is curved, for example, by fitting the unprocessed connecting part 62 into a U-shaped mold (not shown). As the unprocessed connecting part 62 is curved, the first pleats 42 on the inner side of the curve and the second pleats 44 on the outer side of the curve are each pulled in the curving direction (axial direction).

Figure 6C:
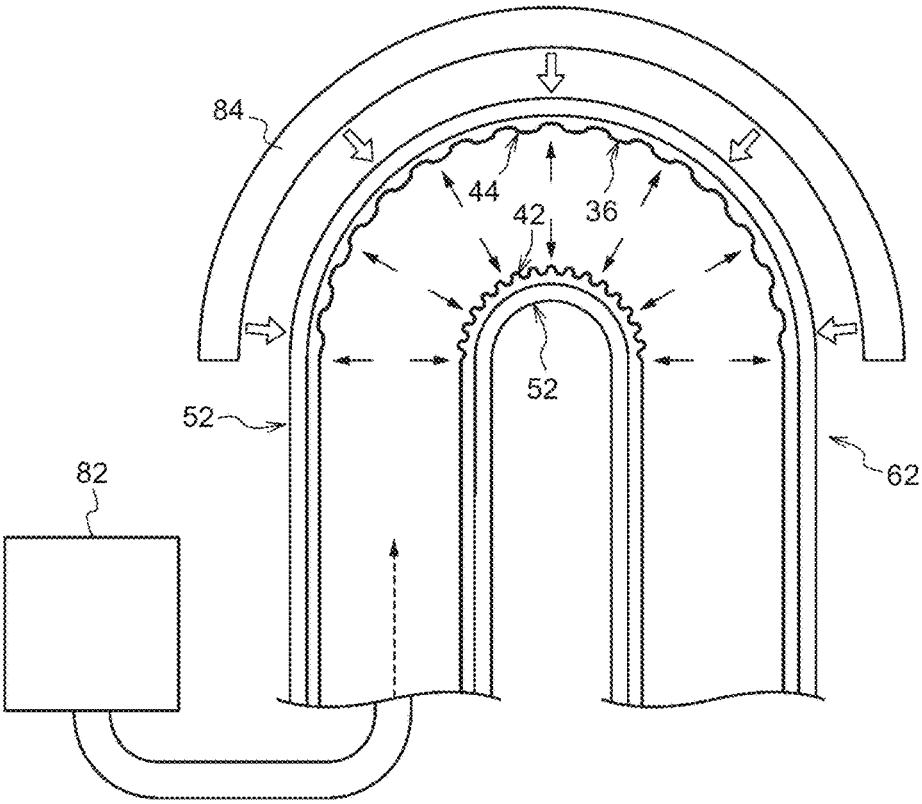
FIG. 6C is an illustration showing how the unprocessed connecting part of FIG. 6B is heated and pressurized.

Then, as shown in FIG. 6C, the curved liner 36 and fiber-reinforced part 52 are heated with a heater 84 while the inside of the liner 36 is pressurized with a compressor 82 (an example of a step of pressurizing and heating). To clearly show how the liner 36 and the fiber-reinforced part 52 are heated and pressurized, the mold is not shown and the heater 84 is only partially shown in FIG. 6C.

Here, the liner 36 is subjected to a tensile force in the curving direction and the internal pressure of the liner 36 is raised by pressurization with the compressor 82, so that the height of the first pleats 42 on the inner side of the curve and the height of the second pleats 44 on the outer side of the curve become smaller than those before curving. As a result, the clearance between the first pleats 42 and the fiber-reinforced part 52, and the clearance between the second pleats 44 and the fiber-reinforced part 52 are reduced. In other words, the area of contact between the fiber-reinforced part 52 and the pleated part 38 is increased. The resin in the liner 36 and the resin in the fiber-reinforced part 52 are cured by heating.

Figure 6D:
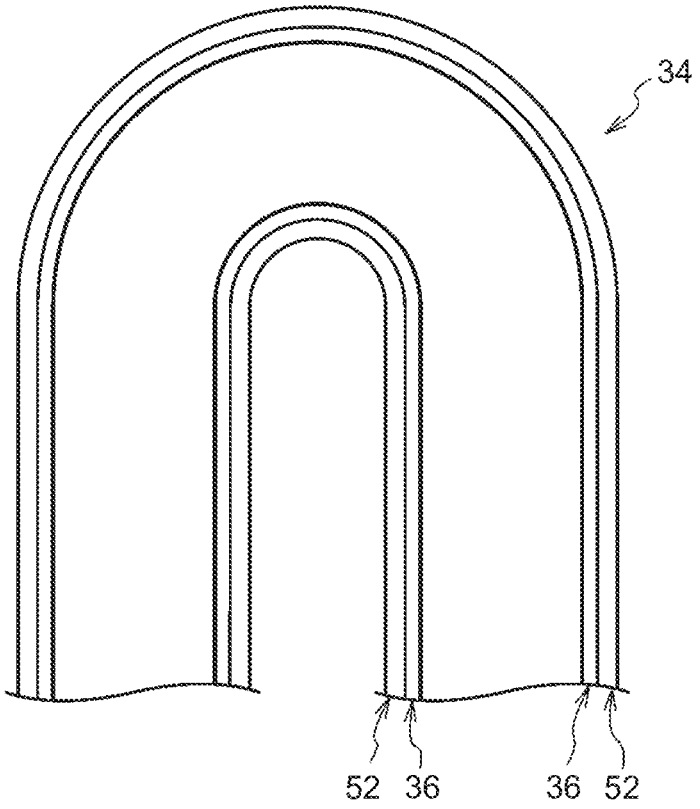
FIG. 6D is a partial vertical sectional view showing the connecting part of FIG. 1 upon completion.

Through these steps, the connecting part 34 is formed as shown in FIG. 6D. The connecting part 34 is connected at one end and the other end in the axial direction by adhesion to the vessel main body 32A and the vessel main body 32B (see FIG. 1) that have been separately formed. Thus, the vessel main body 32A, the vessel main body 32B, and the connecting part 34 are integrated. The other connecting parts 34 are connected to the other vessel main bodies 32 (see FIG. 1) in the same manner to form the high-pressure vessel 30 (see FIG. 1).

As has been described above, in the manufacturing method of the high-pressure vessel 30, the height h1 of the first pleats 42 is set to be smaller than the height h2 of the second pleats 44. This allows the first pleats 42 to be stretched out along the curving direction at the part of the liner 36 on the inner side of the curve when the liner 36 and the fiber-reinforced part 52 are curved. In other words, the clearance in the Y-direction between the ridges 42A of the first pleats 42 and the fiber-reinforced part 52 is reduced. As a result, the area of contact between the first pleats 42 and the fiber-reinforced part 52 is increased and the degree of freedom for deformation of the first pleats 42 is reduced. Thus, this method can ensure that when the liner 36 and the fiber-reinforced part 52 are curved and then the inside of the curved liner 36 is pressurized (the high-pressure vessel 30 is used), the part of the liner 36 on the inner side of the curve is less prone to deformation.

Figure 7:
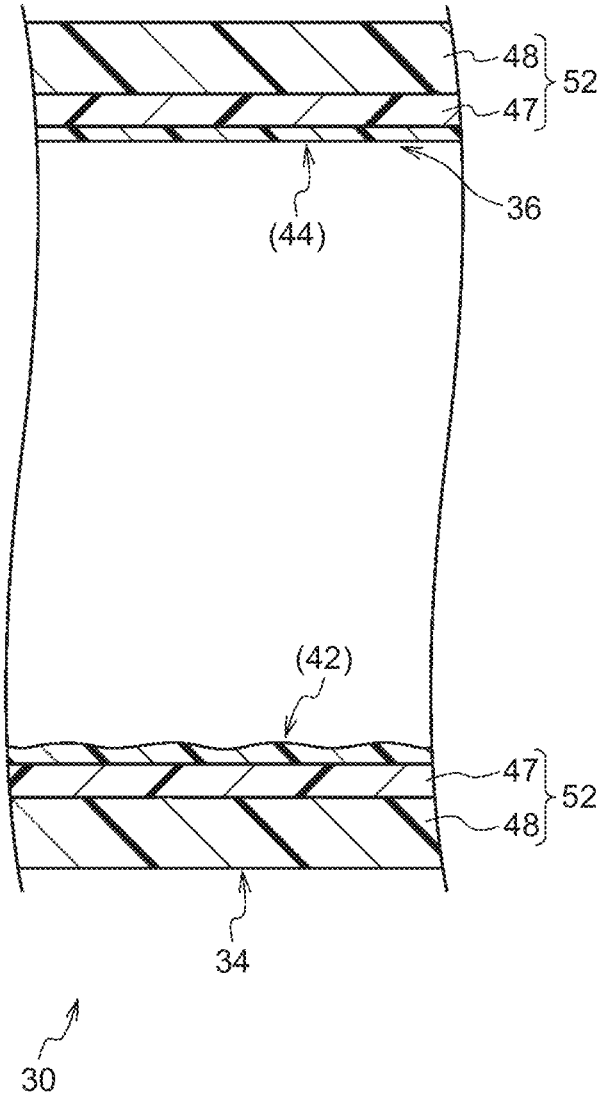
FIG. 7 is a partial vertical sectional view showing part of the connecting part of FIG. 6D.

As shown in FIG. 7, slight ridges remain at the portion corresponding to the first pleats 42 in the connecting part 34 of the high-pressure vessel 30 having been formed. However, the degree of close contact with the fiber-reinforced part 52 at the portion corresponding to the first pleats 42 and that at the portion corresponding to the second pleats 44 are equivalent.

Second Embodiment

Next, a high-pressure vessel 90 as an example of a pressure vessel according to a second embodiment and a manufacturing method of the high-pressure vessel 90 will be described.

Figure 8:
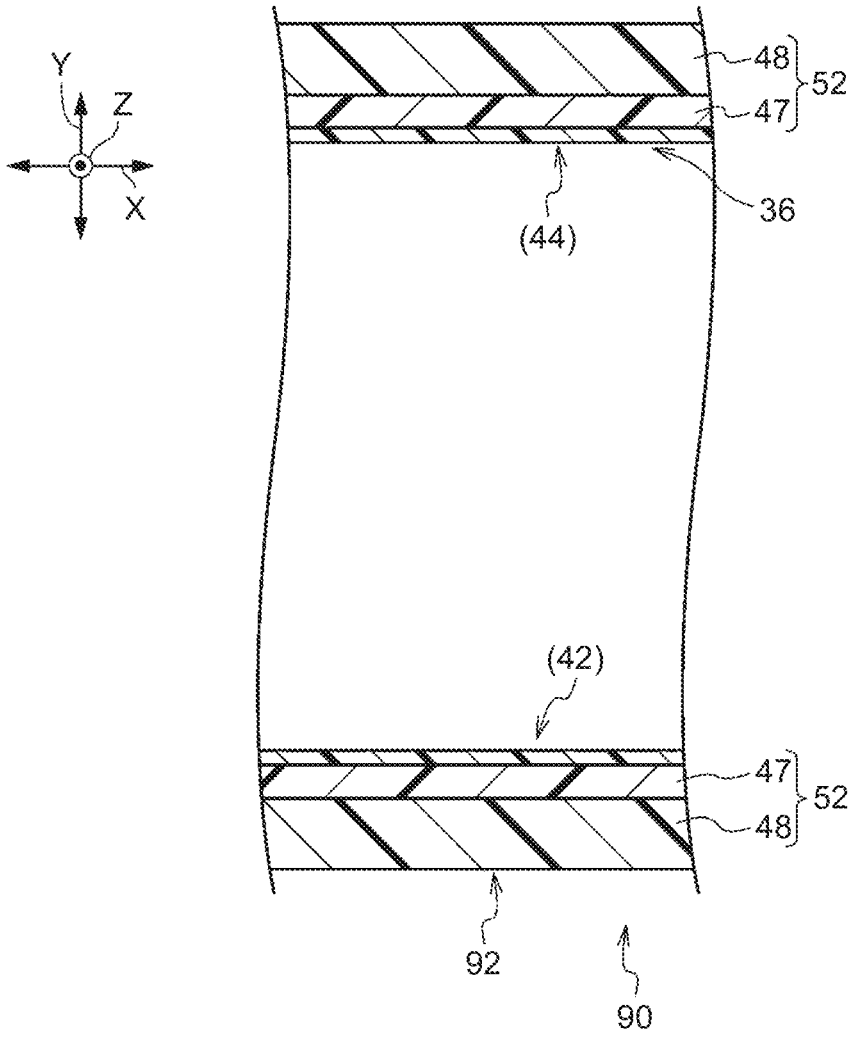
FIG. 8 is a partial vertical sectional view showing a connecting part of a high-pressure vessel according to a second embodiment upon completion.

The high-pressure vessel 90 shown in FIG. 8 is provided in the vehicle 10 (see FIG. 1) in place of the high-pressure vessel 30 (see FIG. 1). Those components of the high-pressure vessel 90 that are basically the same as in the high-pressure vessel 30 will be denoted by the same reference signs as in the high-pressure vessel 30 while the description thereof will be omitted. For example, the high-pressure vessel 90 has five vessel main bodies 32 (see FIG. 1) and four connecting parts 92 (see FIG. 8).

The basic configuration of the connecting part 92 is the same as that of the connecting part 34 (see FIG. 7). However, different conditions of pressurization are used in manufacturing, so that the portion of the connecting part 92 corresponding to the first pleats 42 (see FIG. 5) of the connecting part 34 (see FIG. 4) is different in shape from the first pleats 42.

More particularly, a pressure higher than the pressure applied to the inside of the connecting part 34 (see FIG. 6D) in the first embodiment is used for pressurizing the unprocessed connecting part 62 (see FIG. 6C) to form the connecting part 92. This pressure is adjusted by adjusting the pressure in the compressor 82 (see FIG. 6C) or changing the compressor 82. The amount of the pressure is set such that the first pleats 42 after heating form a curved part extending along the fiber-reinforced part 52 as seen from the X-direction. In other words, the amount of the pressure is set such that the first pleats 42 after heating have a linear shape extending along the fiber-reinforced part 52 as seen from the Z-direction.

Workings and Effects

Next, the manufacturing method of the high-pressure vessel 90 of the second embodiment will be described. In the following, only differences from the manufacturing method of the high-pressure vessel 30 (see FIG. 1) will be described while the description of the same steps will be omitted.

After the unprocessed connecting part 62 (see FIG. 6C) is curved, the inside of the curved liner 36 is pressurized with the compressor 82 (see FIG. 6C). Since the liner 36 is subjected to a tensile force in the curving direction and the internal pressure of the liner 36 is raised by pressurization with the compressor 82, the height of the first pleats 42 on the inner side of the curve and the height of the second pleats 44 on the outer side of the curve become smaller than those before curving.

Here, the pressure applied to the inside of the liner 36 is higher than the pressure applied in the first embodiment, so that not only the second pleats 44 on the outer side of the curve but also the first pleats 42 on the inner side of the curve are deformed so as to extend along the fiber-reinforced part 52. As a result, the clearance between the first pleats 42 and the fiber-reinforced part 52, and the clearance between the second pleats 44 and the fiber-reinforced part 52 are reduced. In other words, the area of contact between the fiber-reinforced part 52 and the pleated part 38 is increased. The resin in the liner 36 and the resin in the fiber-reinforced part 52 are cured by heating.

Through these steps, the connecting part 92 shown in FIG. 8 is formed. The connecting part 92 is connected at one end and the other end in the axial direction by adhesion to the vessel main body 32A and the vessel main body 32B (see FIG. 1) that have been separately formed. Thus, the vessel main body 32A, the vessel main body 32B, and the connecting part 92 are integrated. The other connecting parts 92 are connected to the other vessel main bodies 32 in the same manner to form the high-pressure vessel 90.

As has been described above, in the manufacturing method of the high-pressure vessel 90, the height h1 of the first pleats 42 (see FIG. 5) is set to be smaller than the height h2 of the second pleats 44 (see FIG. 5). This allows the first pleats 42 to be stretched out along the curving direction at the part of the liner 36 on the inner side of the curve when the liner 36 and the fiber-reinforced part 52 are curved. In other words, the clearance in the Y-direction between the ridges 42A of the first pleats 42 and the fiber-reinforced part 52 is reduced. As a result, the area of contact between the first pleats 42 and the fiber-reinforced part 52 is increased and the degree of freedom for deformation of the first pleats 42 is reduced. Thus, this method can ensure that when the liner 36 and the fiber-reinforced part 52 are curved and then the inside of the curved liner 36 is pressurized, the part of the liner 36 on the inner side of the curve is less prone to deformation.

In the manufacturing method of the high-pressure vessel 90, a predetermined pressure is applied in the process of heating the liner 36 while pressurizing the inside of the liner 36, so that not only the second pleats 44 on the outer side of the curve but also the first pleats 42 on the inner side of the curve are deformed so as to have a smaller height after heating. Moreover, the first pleats 42 after heating form a curved part extending along the fiber-reinforced part 52 as seen from the curving direction. Thus, applying the predetermined pressure to the first pleats 42 and the second pleats 44 can cause not only the second pleats 44 but also the first pleats 42 to assume a shape extending along the X-direction. As a result, the area of contact between the first pleats 42 and the fiber-reinforced part 52 is increased compared with when a low pressure is applied, and the clearance between the first pleats 42 and fiber-reinforced part 52 after heating can be reduced accordingly.

The present disclosure is not limited to the above-described embodiments.

The number of the vessel main bodies 32 is not limited to five but may be two or any number other than five that is not smaller than three. The number of the connecting parts 34, 92 is not limited to four but may be one or any number other than four that is not smaller than two.

The length in the X-direction of the pleated part 38 may be set to be equal to the length in the X-direction of the connecting parts 34, 92. In other words, the entire connecting parts 34, 92 may be pleated. The length in the X-direction of the pleated part 38 is not limited to a length of about a quarter of the length in the X-direction of the connecting parts 34, 92, and may be set to a length other than this quarter length and shorter than the length in the X-direction of the connecting parts 34, 92.

Figure 9:
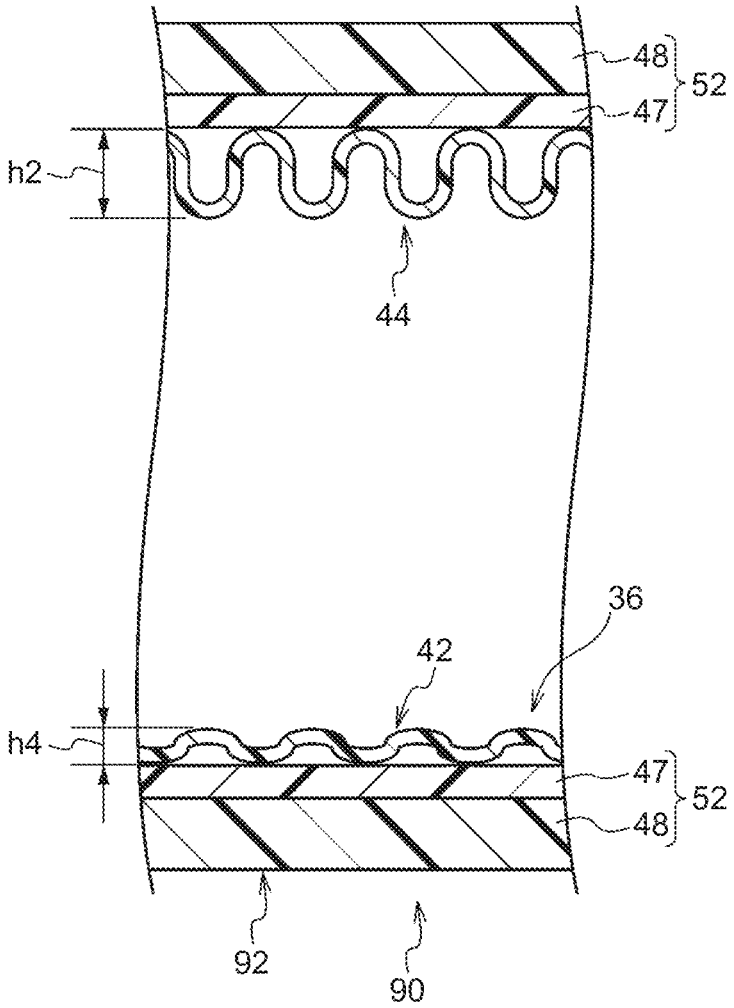
FIG. 9 is a partial vertical sectional view showing part of a connecting part of a high-pressure vessel according to a modified example.

The height h1 in the Y-direction of the first pleats 42 may be set to an even smaller height while the same conditions of pressurization as in the first embodiment are used. FIG. 9 shows a state where a height h4 [mm] in the Y-direction of the first pleats 42 before curving is set to be smaller than the height h1 (see FIG. 4). Thus, setting the height of the first pleats 42 to an even smaller height can increase the area of contact between the portion of the first pleats 42 and the fiber-reinforced part 52 even when the conditions of pressurization are the same.

The height h3 may be set to be equal to the height h1 or the height h2. The height h3 may be set to be smaller than the height h2.

The vessel main bodies 32 and the connecting parts 34, 92 are not limited to those that are molded as separate bodies and then connected to each other by adhesion, and these members may instead be integrally molded.

The fiber-reinforced part 52 is not limited to the one that has the inner reinforcing layer 47 and the outer reinforcing layer 48, and the fiber-reinforced part 52 may instead have only either one of these layers.

The gas is not limited to the hydrogen gas G and may instead be another gas, such as oxygen or air.

While examples of the pressure vessel manufacturing method according to the embodiments and the modified examples of the present disclosure have been described above, it should be understood that these embodiments and modified examples may be combined as appropriate, and that the present disclosure can be implemented in various forms within the scope of the gist of the disclosure.

What is claimed is:

1. A pressure vessel manufacturing method, comprising:

molding a resin tubular body that connects one vessel main body and another vessel main body to each other, with a pleated part formed at least at part of the tubular body in an axial direction;

forming a reinforcing part that reinforces the tubular body on an outer circumferential side of the tubular body;

curving the tubular body and the reinforcing part such that an axis of the tubular body draws a curved line; and heating the tubular body and the reinforcing part while pressurizing an inside of the curved tubular body, wherein, in the molding the tubular body, the pleated part has a pleat including a first point with a minimum height disposed on an inner side of the curved tubular body relative to the axis and a second point with a maximum height disposed on an outer side of the curved tubular body relative to the axis, the first and second points being diametrically opposite to each other, wherein the minimum height is greater than zero.

2. The pressure vessel manufacturing method according to claim 1, wherein an amount of a pressure applied to pressurize the inside of the tubular body is set such that the first point of the pleat after heating forms a curved part extending along the reinforcing part.

3. The pressure vessel manufacturing method according to claim 1, wherein, in said pressurizing, a pressure applied to pressurize the inside of the tubular body is set such that the first point of the pleat after said heating is smoothened and has a linear shape in a cross section.

4. The pressure vessel manufacturing method according to claim 1, wherein said curving comprises fitting an unprocessed connecting part, which comprises the reinforcing part formed on the outer circumferential side of the tubular body, into a U-shaped mold.

5. A pressure vessel manufacturing method, comprising:

molding a resin tubular body that connects one vessel main body and another vessel main body to each other, with a pleated part formed at least at part of the tubular body in an axial direction;

forming a reinforcing part that reinforces the tubular body on an outer circumferential side of the tubular body;

curving the tubular body and the reinforcing part such that an axis of the tubular body draws a curved line; and heating the tubular body and the reinforcing part while pressurizing an inside of the curved tubular body, wherein, in the molding the tubular body, a height of first pleats of the pleated part that are disposed on an inner side of the curved tubular body relative to the axis is set to be smaller than a height of second pleats of the pleated part that are disposed on an outer side of the curved tubular body relative to the axis, and wherein the pleated part is formed over an entire length of the tubular body along the axial direction.

6. A pressure vessel manufacturing method, comprising:

molding a resin tubular body that connects one vessel main body and another vessel main body to each other, with a pleated part formed at least at part of the tubular body in an axial direction;

forming a reinforcing part that reinforces the tubular body on an outer circumferential side of the tubular body;

curving the tubular body and the reinforcing part such that an axis of the tubular body draws a curved line; and heating the tubular body and the reinforcing part while pressurizing an inside of the curved tubular body, wherein, in the molding the tubular body, a height of first pleats of the pleated part that are disposed on an inner side of the curved tubular body relative to the axis is set to be smaller than a height of second pleats of the pleated part that are disposed on an outer side of the curved tubular body relative to the axis, and wherein said forming the reinforcing part comprises:

forming an inner reinforcing layer of a first material over the outer circumferential side of the tubular body, and forming an outer reinforcing layer of a second material over an outer circumferential side of the inner reinforcing layer, the second material different from and thicker than the first material.

7. The pressure vessel manufacturing method according to claim 6, wherein the first material comprises carbon fibers, and the second material comprises glass fibers.

8. The pressure vessel manufacturing method according to claim 6, wherein the first material comprises carbon fiber-reinforced plastic, and the second material comprises glass fiber-reinforced plastic.

* * * * *